US008183972B2

(12) United States Patent
Hjortsberg et al.

(10) Patent No.: US 8,183,972 B2
(45) Date of Patent: May 22, 2012

(54) OIL FILLED TRANSFORMER WITH SPACERS AND SPACERS FOR SEPARATING AND SUPPORTING STACKED WINDINGS

(75) Inventors: Arne Hjortsberg, Fislisbach (CH); Jan Hajek, Ludvika (SE)

(73) Assignee: ABB Technology Ltd., Zürich (CH)

( * ) Notice: Subject to any disclaimer, the term of this patent is extended or adjusted under 35 U.S.C. 154(b) by 418 days.

(21) Appl. No.: 11/992,895

(22) PCT Filed: Sep. 29, 2006

(86) PCT No.: PCT/SE2006/050362

§ 371 (c)(1),
(2), (4) Date: May 4, 2010

(87) PCT Pub. No.: WO2007/037756

PCT Pub. Date: Apr. 5, 2007

(65) Prior Publication Data

US 2011/0037551 A1 Feb. 17, 2011

(30) Foreign Application Priority Data

Sep. 29, 2005 (SE) ..... 0502170

(51) Int. Cl.
*H01F 27/24* (2006.01)
*H01F 17/06* (2006.01)

(52) U.S. Cl. ..... 336/216; 336/65; 336/219; 336/175

(58) Field of Classification Search ..... None
See application file for complete search history.

(56) References Cited

U.S. PATENT DOCUMENTS

| | | | | | |
|---|---|---|---|---|---|
| 3,748,616 | A | * | 7/1973 | Weber et al. | 336/60 |
| 3,775,719 | A | * | 11/1973 | Gainer et al. | 336/58 |
| 3,902,146 | A | * | 8/1975 | Muralidharan | 336/57 |
| 4,145,679 | A | * | 3/1979 | Mitchell, Jr. | 336/57 |
| 4,219,791 | A | * | 8/1980 | Moore et al. | 336/58 |
| 5,296,829 | A | * | 3/1994 | Kothmann et al. | 336/60 |
| 6,870,374 | B2 | * | 3/2005 | Perkins et al. | 324/551 |

FOREIGN PATENT DOCUMENTS

| | | | | |
|---|---|---|---|---|
| DE | 10337153 | A1 | | 3/2005 |
| JP | 53085332 | A | * | 7/1978 |
| JP | 6021513 | A | * | 2/1985 |
| JP | 9092549 | A | | 4/1997 |
| JP | 2001345228 | A | | 12/2001 |

OTHER PUBLICATIONS

PCT/ISA/210—International Search Report—Nov. 15, 2006.
PCT/ISA/237—Written Opinion of the International Searching Authority—Nov. 15, 2006.

* cited by examiner

*Primary Examiner* — Anh Mai
(74) *Attorney, Agent, or Firm* — Venable LLP; Eric J. Franklin

(57) ABSTRACT

An oil filled high power transformer for high voltages with coils. The transformer including a number of stacked layers of, in the main concentric, insulated conductors forming transformer coils. The winding layers are separated by spacers. One or more spacers are provided with at least one integrated electrical discharge barrier extending off the central body of the spacer in the vicinity of the area where the spacer is in contact with a winding. Breakdown along spacer and alongside the spacer-oil interface is reduced getting improved breakdown strength of the oil filled transformer.

25 Claims, 4 Drawing Sheets

OIL FILLED TRANSFORMER WITH SPACERS AND SPACERS FOR SEPARATING AND SUPPORTING STACKED WINDINGS

CROSS-REFERENCE TO RELATED APPLICATIONS

This application claims priority to Swedish patent application 0502170-4 filed 29 Sep. 2005 and is the national phase under 35 U.S.C. §371 of PCT/SE2006/050362.

FIELD OF THE INVENTION

The present invention relates to oil filled power transformer for high voltages with coils comprising a number of stacked winding layers comprising windings of insulated conductors, which winding layers are separated by spacers serving as distance and support members and arranged preferably perpendicular to the conductors, which spacers comprising a central body with upper and lower planes.

The invention further relates to a spacer for separating and supporting stacked winding layers of insulated conductors of a transformer coil at an oil filled transformer, which spacer comprises an elongated central body comprising upper and lower planes.

BACKGROUND OF THE INVENTION

The main functions of spacers in oil filled transformers are to mechanically separate and support windings. Typically they are also stressed electrically with an AC electrical field and a high impulse electric field in testing, which is often dimensioning for the spacer thickness.

When transformer designs are optimized for maximum compactness the spacer ability to accept a high dielectric stress becomes vital. The allowed voltage between coils in transformers is often limited by the initiation of a breakdown outside the spacer and along the spacer-oil interface.

This effect occurs primarily as a result of the different dielectric constants of typical spacer materials and transformer oil. When a higher dielectric constant material like pressboard and transformer oil meet at a conductor, the electric field in the oil wedge is enhanced by a factor approximately equal to the ratio of dielectric constants, or 4.5/2.2=approximately 2 in the pressboard-oil case. There are several geometric ways that this field enhancement can occur.

Where a rounded spacer is in contact with the conductor, an oil wedge occurs in the contact area of the spacer and the conductor. The electric field in this arrangement increases at the contact area. The field in the contact area is approximately twice the average field away from the conductor. It is also known that the interface along the spacers is a weak point and that electric breakdowns preferable occur in the vicinity of the spacers. The oil volume exposed to this field enhancement depends on the geometry of the spacer, and is normally quite small.

Another critical area is where rounded conductors and spacers comes into contact with spacers which are arranged perpendicular to the conductors.

This oil wedge is present along the conductor on all turns of the transformer and consequently has a quite large volume and consequently a larger probability for triggering a discharge during impulse testing. Such a discharge created between the spacer and the conductor is probably not too dangerous if it happens far from the edges of the spacers, but if it happens close to the spacer edge there should be a substantial risk that the discharge propagates along the spacer-oil interface to the next winding layer, causing a breakdown. The observation in real testing is also that breakdown preferentially does occur at spacers.

Still another critical area is where an axial spacer, conductor corner and a radial spacer meet. At the outermost turn of a disc winding the conductor meets an axial pressboard spacer, which defines the distance to the next barrier. This barrier is followed by a further spacer, a new barrier etc. The result is a similar field enhancement at the axial spacer oil wedge, and a combined axial and radial field enhancement occurs at the outer conductor edge. This is the most vulnerable part of the winding, with the highest failure probability.

The present invention seeks to provide an improved oil filled power transformer and improved spacers getting improved breakdown strength of the transformer.

DESCRIPTION OF THE INVENTION

Brief Summary of the Invention

According to an aspect of the present invention, there is provided an oil filled transformer.

According to another aspect of present the invention, there is provided a spacer.

The insulation system is strengthened by creating barriers to the discharges that occur at the spacer edges, by altering the shape of the spacer. By this the discharge streamers are stopped by the barriers created by the addition of "wings" on the spacers. As these extension wings are thin in relation to the total spacer thickness they do not themselves increase the oil field substantially, as the straight prior art spacer do.

The barriers can be extended around critical corner mentioned above. This is achieved by extending the spacer wing barriers in the longitudinal direction of the spacer and bending it up- and/or downwards around the corner to protect the corner and the radial part of the outer coil edge towards the axial spacer.

The suggested shape of spacers can be applied to a range of possible insulating materials including all cellulose, ceramic as well as polymeric materials. The discharge protection effect would be substantial for all solid materials. The wings extending can be manufactured from the same or different material than the spacer itself.

For spacer materials that have a dielectric constant substantially higher than that of the liquid, and hence causes the largest withstand reduction, the insulation improvement would be particularly high. Further, the suggested shape can be applied for axial and radial types of spacers as well as other similar elements in transformers.

BRIEF DESCRIPTION OF THE DRAWINGS

Embodiments of the present invention are schematically illustrated, by way of example only, in the drawings where.

DETAILED DESCRIPTION OF THE DRAWINGS

Figure 1:
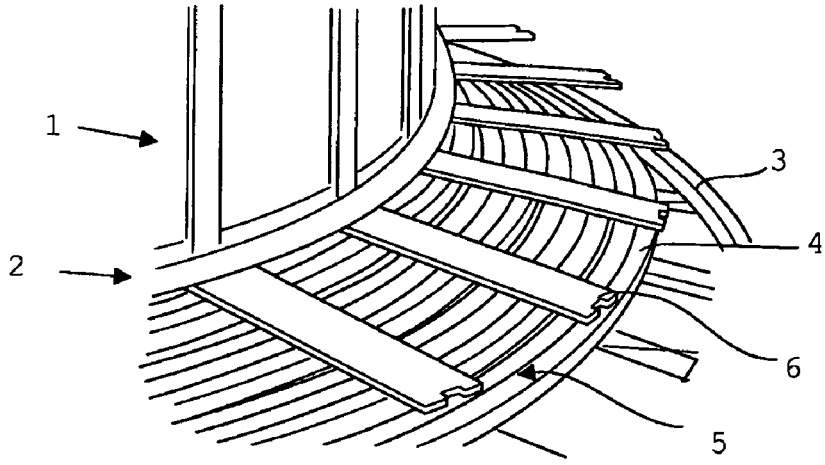
FIG. 1 shows manufacturing of a transformer coil according to prior art.

FIG. 1 shows schematically a coil 2 of a transformer 1 during manufacturing. During the manufacture process insulated conductors 3 are winded so winding layers 5 (so called disk windings) are formed. Between the winding layers 5 radial spacers 6 are placed. The spacers have as the main function to mechanically separate and support the windings 4. Typically they are stressed electrically with an AC electrical field and a high impulse electric field in testing, which is often dimensioning for the spacer thickness.

When transformer designs are optimized for maximum compactness the spacer ability to accept a high dielectric stress becomes vital. The allowed voltage between coils in transformers is often limited by the initiation of a breakdown outside the spacer and along the spacer-oil interface. There are several geometric ways that this field enhancement can occur as we be illustrated in the following FIGS. 2-7.

Figure 2:
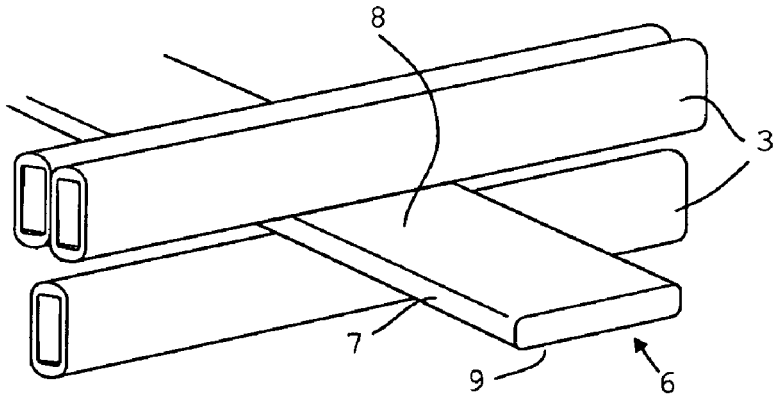
FIG. 2 shows a conventional spacer placed between insulated conductors.

FIG. 2 is a schematic picture of a radial spacer 6 placed between insulated conductors 3 forming a transformer winding. The spacer 6 comprises a central body 7 with an upper plane 8 and a lower plane 9.

Figure 3:
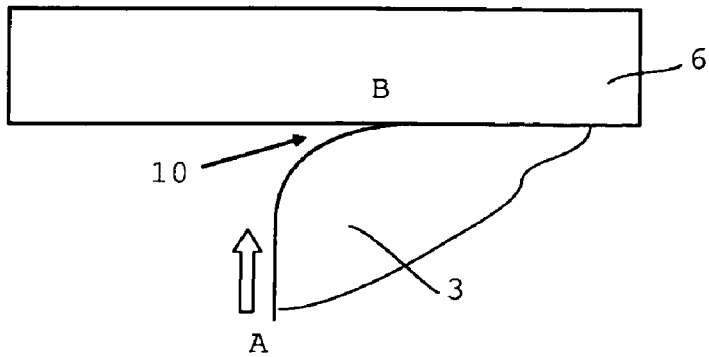
FIG. 3 shows a detail of a conventional spacer and conductor.

FIG. 3 is a schematic view along a radial spacer 6, which is perpendicular to the conductor 3 in a disk winding. A conductor oil wedge 10 is occurring at the edge of a spacer 6 and the conductor 3. The electric field E in this arrangement increases as one proceeds from point A along the interface to B around the corner of the spacer. The field at point B is approximately twice the average field away from the conductor at point A. It is also known that the interface along the spacers is a weak point and that electric breakdowns preferable occur in the vicinity of the spacers. The oil volume exposed to this field enhancement depends on the geometry of the spacer, and is normally quite small.

Figure 4:
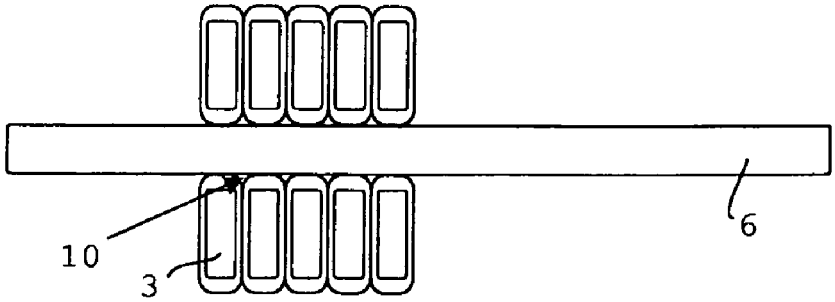
FIG. 4 shows a conventional spacer arranged perpendicular to conductors.

Oil wedges 10 between conductors 3 and at the surface of a spacer 6 are shown in FIG. 4, which is a view along the conductor direction and perpendicular to the spacer.

Figure 5:
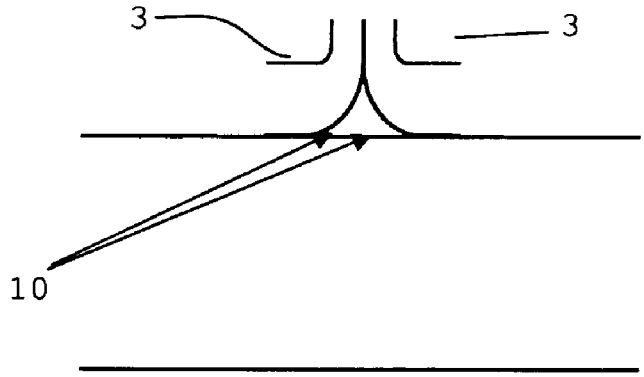
FIG. 5 shows a detail of FIG. 4.

FIG. 5 is a detail of FIG. 4. Here oil wedges 10 occur in the area between the conductors 3 close to the spacer 6. This oil wedge 10 is present along the conductor on all turns of the transformer and consequently has a quite large volume and consequently a larger probability for triggering a discharge during impulse testing. Such a discharge created between the spacer and the conductor is probably not too dangerous if it happens far from the edges of the spacers, but if it happens close to the spacer edge there should be a substantial risk that the discharge propagates along the spacer-oil interface to the next winding layer, causing a breakdown. The observation in real testing is also that breakdown preferentially does occur at spacers.

Figure 6:
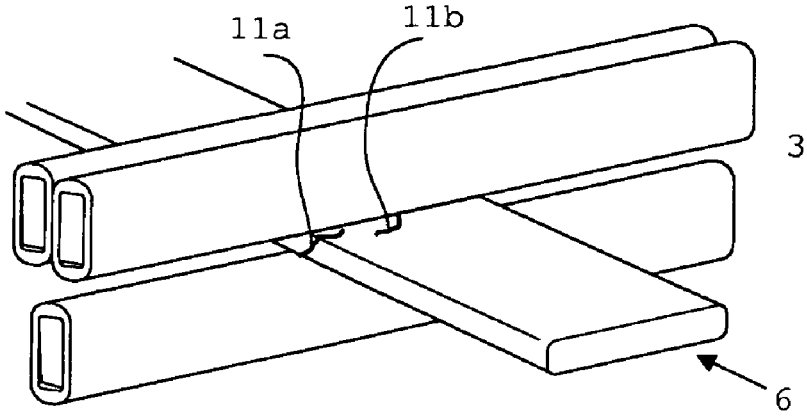
FIG. 6 illustrates oil wedge discharges at a conventional spacer and conductor layers.

FIG. 6 illustrates how a dangerous oil wedge discharge 11*a* occurring close to spacer edge, propagating from one winding layer 5 to the next winding layer, while a less dangerous discharge 11*b* far from edge of the spacer 6 not is propagating.

Figure 7:
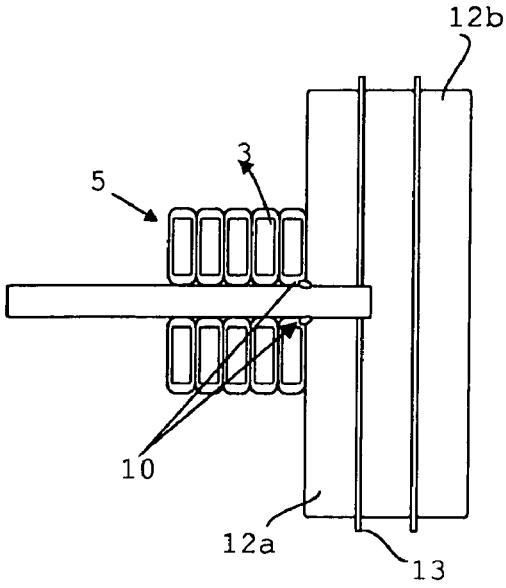
FIG. 7 shows conventional spacer arranged between windings layers and meeting an axial pressboard spacer, FIG. 8 and oil wedge discharge at a prior art spacer.

At the outermost turn of a disc winding 5 the conductor 3 meets an axial pressboard spacer 12*a*, which defines the distance to a next barrier 13. This barrier 13 is followed by a further spacer 12*b*, a new barrier etc. as illustrated in FIG. 7. The result is a similar field enhancement at the axial spacer oil wedge, and a combined axial and radial field enhancement occurs at the outer conductor 3 edge. Axial and radial field enhancements occur due to spacer 6 in addition to the corner radius of the conductor 3. This is the most vulnerable part of the winding, with the highest failure probability.

Figure 8:
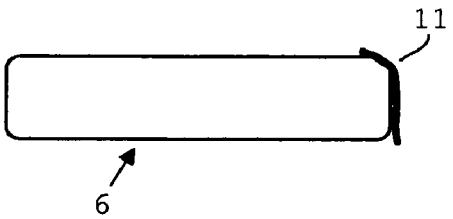

In FIG. 8 schematically is shown how an oil wedge discharge 11 at a prior art spacer 6 propagates from a fist winding layer (not shown) to a second winding layer (not shown).

Figure 9:
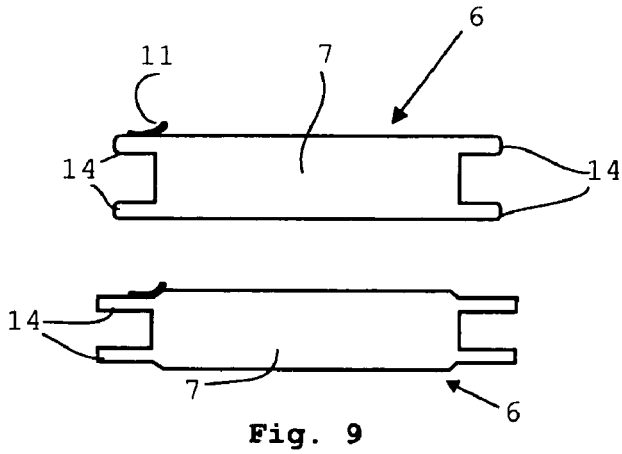
FIG. 9 shows two examples of spacers according to an embodiment of the invention.

In FIG. 9 *a* spacer 6 according to an embodiment of the invention is shown. According to the invention, integrated electric discharge barriers 14 are arranged at the outer ends of the spacers 6, extending off the central body 7 of the spacer 6. Hereby is ensured that the oil wedge discharge 11 do not propagate from one winding layer to next winding layer. As the integrated discharge barriers 14 are thin in relation to the thickness of the central body 7, they do not themselves increase the oil field substantially.

Figure 10:
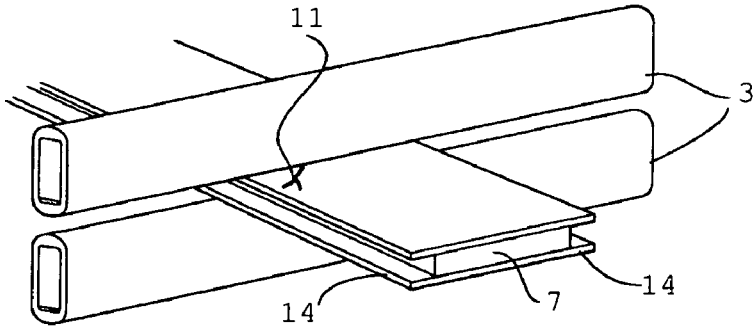
FIG. 10 shows another embodiment of the spacer according to the invention, FIG. 11 *a* and *b* show spacers provided with bent shields according to an embodiment of the invention.

In FIG. 10 another embodiment of the invention is shown. The electrical discharge barrier 14 projects outside the central body 7 at the outer ends as well as alongside said body, and arranged at each side of the central body. The suggested spacer shapes could easily be achieved by adding a wider layer of Pressboard on each side of the spacer or by inserting this layer one step down from the conductors to provide the shapes as illustrated in FIG. 10. Since spacers are commonly made up of thinner spacers on top of each other for modular reasons, this should be a simple and straightforward modification in the spacer manufacturing process.

Figure 11A:
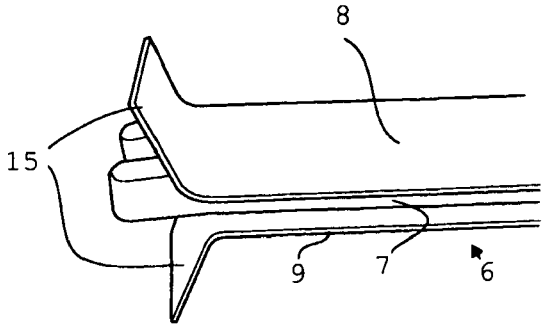
Figure 11B:
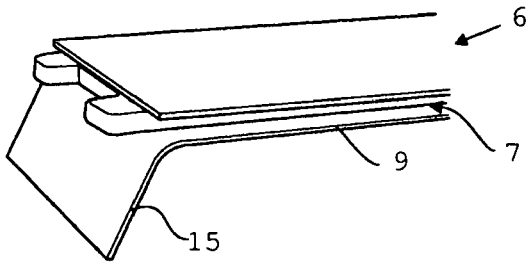

In order to take full advantage of the new spacer shape it could also be extended around critical corners. This can be achieved by extending the discharge barriers in the longitudinal direction of the spacer and bending it up- and/or downwards around the corner forming bent shields to protect the corner and the radial part of the outer coil edge towards the axial spacer. An example of such a design is shown in FIG. 11 *a* and *b*, where FIG. 11 *a* illustrates a spacer having bent shield 15 arranged at the upper plane 8 of the central body 7 and projects in a direction up from said plane and a bent shield arranged at the lower plan 9 projecting in a direction down from said plane. FIG. 11 *b* illustrates a spacer having a bent shield arranged at the lower plane only.

Figure 12:
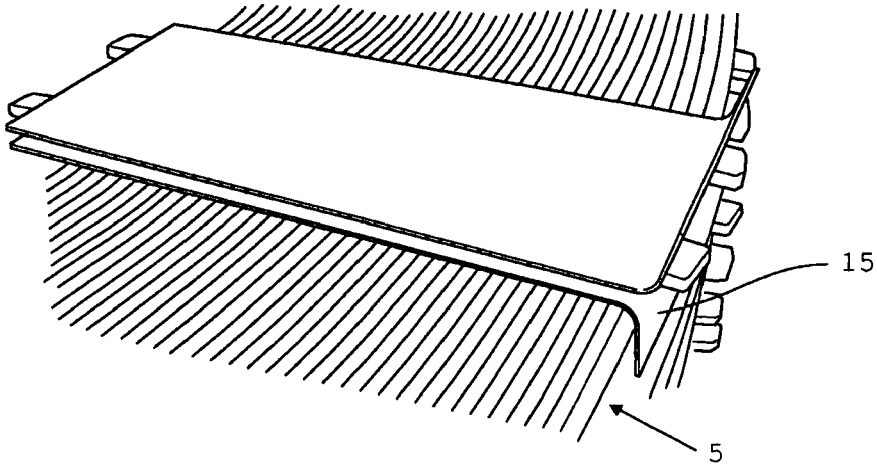
FIG. 12 shows a spacer applied to protect the outer corner of a winding according to an embodiment of the invention.

FIG. 12 illustrates a spacer arranged to protect the outer corner of a winding layer 5. The spacer 6 is accordance with the invention provided with a bent shield 15. Preferably the shield 15 has a vertical height which substantially corresponds to the height of the winding layer 5, so is covers the axial height of a winding layer. Preferably spacers with the bent shields are arranged at the winding layers at the high voltage entrance of the transformer. The high voltage entrance can be at upper or lower end of the coil but also in the middle of a coil, depending of the design of the transformer.

Figure 13:
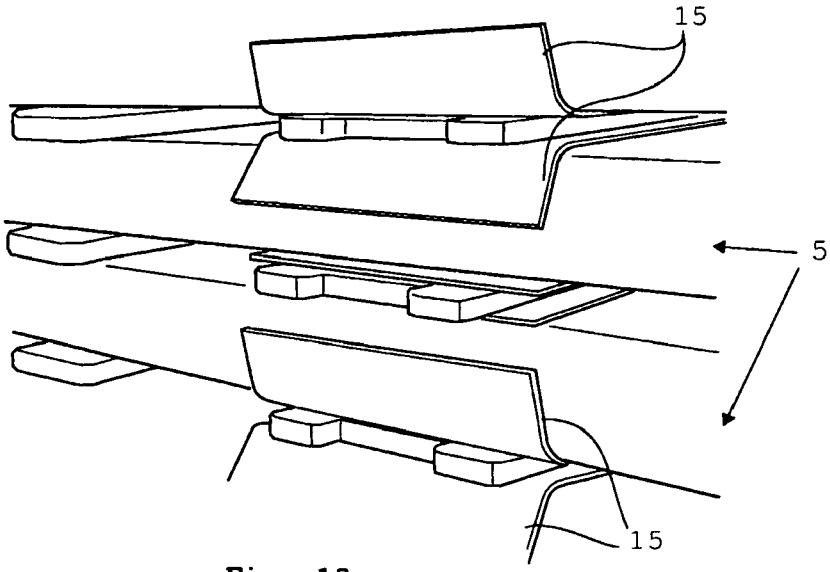
FIG. 13 shows spaces according to an embodiment of the invention arranged between winding layers.

FIG. 13 illustrates how discharge barrier shields are arranged to protect critical outer corner in every second winding layer 5 where the electric field is high.

The suggested shape of spacers can be applied to a range of possible insulating materials including all cellulose, ceramic as well as polymeric materials. The discharge protection effect would be substantial for all solid materials. The discharge barrier and bent shields can be manufactured from the same or different material than the spacer itself.

For spacer materials that have a dielectric constant substantially higher than that of the liquid, and hence causes the largest withstand reduction, the insulation improvement would be particularly high. Further, the suggested shape can be applied for axial and radial types of spacers as well as other similar elements in transformers.

Oil filled transformer according to the invention is designed for high voltage, suitably in excess of 10 kV, in particular in excess of 36 kV, and preferably more than 72 kV and up to very high transmission voltages, such as 400 kV to 800 kV or higher. Further, the oil filled transformer preferably is designed for a power range in excess of 0.5 MVA, in particular in excess of 20 MVA, and preferably more than 100 MVA up to very high power as 1000 MVA and above.

The core of such transformers has a diameter of more than 300 mm and the corresponding coil can have a diameter up to 4000 mm and the conductors cross section has the dimension height×width from 4×1.2 mm up to 18×6 mm.

Any range or device value given herein may be extended or altered without losing the effect sought, as will be apparent to the skilled person for an understanding of the teachings herein.

Disclosures in Swedish patent application No. 0502170-4 of Sep. 29, 2005 from which applications this application claims priority, are incorporated herein by reference.

Preferred embodiments of an oil filled transformer and spacers according to embodiments of the invention have been described. A person skilled in the art realizes that these could also be varied within the scope of the appended claims. Although the transformer has been described as oil filled, it will be appreciated that the transformer also can be filled with other liquids than oil/transformer oil, provided that the liquid having suitable properties as regards dielectric strengths, electric insulation and cooling.

The invention claimed is:

1. An oil filled power transformer for high voltages, the transformer comprising:

coils comprising a plurality of stacked winding layers comprising windings of insulated conductors, and spacers separating the winding layers, the spacers serving as distance and support members, the spacers comprising a central body having upper and lower planes, the spacers comprising integrated electrical discharge barriers extending from the central body of the spacer in the vicinity of the area where the spacer contact the conductors, wherein the discharge barriers at an outer end of the central body comprise a bent shield arranged at least one of the upper plane or the lower plane and projecting in a direction away from the central body.

2. The oil filled transformer according to claim 1, wherein the discharge barrier extends along the central body and in parallel to the respective upper and lower planes.

3. The oil filled transformer according to claim 1, further comprising:

bent shields arranged at both outer ends of the spacer.

4. The oil filled transformer according to claim 3, wherein at least one of the spacers integrated discharge barriers or shields is arranged at the high voltage entrance of the transformer coil.

5. The oil filled transformer according to claim 1, wherein the coils comprising spacers with integrated discharge barriers are designed for high voltage, suitably in excess of 10 kV and up to very high transmission voltages.

6. The oil filled transformer according to claim 5, wherein the coils comprising spacers with integrated discharge barriers are designed for high voltage in excess of 36 kV.

7. The oil filled transformer according to claim 5, wherein the coils comprising spacers with integrated discharge barriers are designed for high voltage in excess of 72 kV.

8. The oil filled transformer according to claim 5, wherein the coils comprising spacers with integrated discharge barriers are designed for up to very high transmission voltages of 400 kV to 800 kV.

9. The oil filled transformer according to claim 5, wherein the coils comprising spacers with integrated discharge barriers are designed for up to very high transmission voltages of higher than 800 kV.

10. The oil filled transformer according to claim 1, wherein the transformer is designed for a power range in excess of 0.5 MVA.

11. The oil filled transformer according to claim 10, wherein the transformer is designed for a power range in excess of 20 MVA.

12. The oil filled transformer according to claim 10, wherein the transformer is designed for a power range in excess of more than 100 MVA.

13. The oil filled transformer according to claim 10, wherein the transformer is designed for a power range in excess up to very high power as 1000 MVA and above.

14. A spacer for separating and supporting stacked winding layers of insulated conductors of a transformer coil at an oil filled transformer, the spacer comprising:

an elongated central body comprising upper and lower planes, and an integrated electrical discharge barrier projecting outside the central body, wherein the integrated electrical discharge barriers extend from the central body and at an outer end of the central body comprise a bent shield arranged at least one of the upper plane or the lower plane and projecting in a direction away from the central body.

15. The spacer according to claim 14, wherein the discharge barrier projects alongside the central body and in a direction in parallel to adjacent plane.

16. The spacer according to claim 14, wherein the discharge barriers are arranged at the upper and/or lower part of the central body.

17. The spacer according to claim 16, wherein the bent shields have a vertical height which substantially corresponds to the height of a winding layer.

18. The spacer according to claim 14, wherein discharge barriers are arranged at the outer ends of the central body.

19. The spacer according to claim 14, wherein the bent shields are arranged at both outer ends of the spacer.

20. The spacer according to claim 19, wherein the central body has a thickness of 2-9 mm, a length of 20-500 mm and a width of 20-100 mm and wherein a thickness of the discharge barriers is between 0.1-10 mm, and the width of the barrier and/or the bent shield is between 3-20 mm.

21. The spacer according to claim 20, wherein the thickness of the discharge barriers is between 0.2-0.5 mm.

22. The spacer according to claim 20, wherein the width of the barrier and/or the bent shield is 10 mm.

23. The spacer according to claim 14, wherein the bent shields are arranged at upper and lower part of the central body.

24. The spacer according to claim 14, wherein at least one of the spacer body, the integrated discharge barrier or the bent shield comprise cellulose material, ceramic material or polymeric material.

25. The spacer according to claim 24, wherein the cellulose material comprises pressboard.

* * * * *